United States Patent [19]

Fischer et al.

[11] Patent Number: 4,988,002

[45] Date of Patent: Jan. 29, 1991

[54] CONTAINER FOR RECEIVING STACKS OF STAPLED SHEETS

[75] Inventors: Ulrich Fischer, Kirchheim-Teck; Frank Goeltenboth, Ulm; Hans-Juergen Kurze, Remseck; Heinz Wagner, Wiesensteig, all of Fed. Rep. of Germany

[73] Assignee: Eastman Kodak Company, Rochester, N.Y.

[21] Appl. No.: 509,458

[22] Filed: Apr. 16, 1990

[30] Foreign Application Priority Data

May 17, 1989 [DE] Fed. Rep. of Germany ..... 3916038

[51] Int. Cl.[5] ..... B65D 85/62

[52] U.S. Cl. ..... 206/449; 206/555

[58] Field of Search ..... 206/449, 555, 557, 559

[56] References Cited

U.S. PATENT DOCUMENTS 4,444,319 4/1984 Sharber ..... 206/449

*Primary Examiner*—William I. Price

*Attorney, Agent, or Firm*—Lawrence P. Kessler

[57] ABSTRACT

A container for receiving stacks of sheets which are connected with each other in a corner by means of staples. The support surface (1) provided for supporting the stacks has a recess (31) in an area aligned with the stapled corners of the stacks. The recess allows the stapled corners to be deflected downwardly. The support surface (1) is uneven, its uneven shape being selected such that the stack to be received is supported at least along an elevation in such a way that the inherent stiffness of the stack is broken so that the stapled corners can be reliably deflected down into the recess (31).

21 Claims, 2 Drawing Sheets

CONTAINER FOR RECEIVING STACKS OF STAPLED SHEETS

BACKGROUND OF THE INVENTION

The invention relates to a container for receiving stacks of sheets which are connected in one corner by staples, such container including a support surface and a recess which is provided at a side edge of the support surface for the stapled corners of the stacks received on the support surface.

A typical container for receiving stacks of stapled sheets is known from DE-GM 84 24 581. This known container is provided in a copier which is equipped with means for stapling stacked copy sheets. In the case of the known container, the accuracy with which the pack of stacks is formed from several superimposed stacks of stapled sheets leaves much to be desired. In spite of the presence of a recess in the support surface which is to allow the thick stapled corners of the stacks to be deflected downwardly, it very often happens that the stacks are inaccurately received and the stack packs are thickened in the corners carrying the staples because the corners are not lowered adequately and in the desired manner into the recess.

SUMMARY OF THE INVENTION

It is an object of the invention to provide a container in which accurate receipt of the stacks is ensured so that stack packs are formed whose upper sides do not have an upward curvature in the area of the stapled corners. In the container in accordance with the invention, the sheet stack support surface is uneven relative to an imaginary reference plane, and the support surface has an elevation rising above the reference plane adjacent to the edge of a recess for receiving the stapled corners of the stacks. Accordingly, the stack is supported on the surface such that its inherent stiffness is broken. As a result, the stack is brought into a bendable, slack condition in which the corners which are located outside the area aligned with the elevation hang downwardly in a slack manner. Consequently, it is ensured that the stapled corner is promptly lowered in the area of the recess of the support surface. As a result of such prompt lowering of the stapled corner, it is possible in many cases for the stapled corner of a preceding stack fed to be deflected completely out of the way when a fresh stack is fed to the support surface so that such stack cannot abut the staples of the previously fed stack and cannot thus be laterally displaced.

The stiffness of the stack is broken with particular reliability if the elevation forms a peak area of the support surface which rises up to such elevation. In the case of advantageous embodiments of this invention, the arrangement is such that the elevation is associated with that half of the stack to be deposited which is separated by a diagonal from the half which includes the stapled corner. If the container is intended for stacks of different sheet formats, the elevation is preferably located in the vicinity of the diagonal of a stack to be deposited which has the minimum width, measured vertically to the direction of sliding. In order to reach a well-defined position of the stack, an advantageous embodiment provides that the reference plane and thus the support surface are inclined toward the horizontal, and a direction of sliding of the stack relative to the support surface is defined in that an abutment is provided at the lower edge of the support surface and that the recess is arranged at the upper edge of the support surface.

If stacks are to be deposited which have a relatively long format with respect to the direction of sliding, it has proved to be advantageous that in the area of the upper edge of the support surface, at a distance from the recess measured vertically to the direction of sliding, a second elevation is provided which has substantially the shape of a ramp rising in a direction opposite to the direction of sliding. This ramp raises the point of gravity of stacks extending beyond the upper edge of the support surface so that it is ensured that such long stacks, too, slide along the support surface to the abutment according to the inclination of such surface. At the same time, the at least temporary additional support of the upper corner opposite to the stapled corner ensures that stapled corner is lowered with particular reliability in the area of the recess.

Since the stiffness of the stack is broken and the stapled corners can thus be reliably lowered into the recess of the support surface, it is attained in accordance with the invention that the pack of stacks has no local elevation in the area where the staples are. Thus, the complete capacity for receiving stacks is available in the container.

According to another advantageous embodiment of the invention, an alignment surface for the side edge of the stack extending along the direction of sliding is provided adjacent to the recess. The alignment surface forms an upwardly opening acute angle with the direction of sliding of the stack, and a rotating means is provided by which the stacks contacting the abutment are rotatable so that their side edges extending in the direction of sliding can contact the alignment surface. This yields the additional advantage that the stacks are superimposed and exactly aligned in the packs in which they are combined. That is to say, the stacks are not only exactly guided by the lower abutment with respect to their position along their slide path across the support surface, but each stack is also in a precisely defined angular position. This results from the alignment surface and the rotating means rotating the stack into an angular position in which each stack is pivoted with one lateral edge into contact with the alignment surface. Since, moreover, the alignment surface is oblique with respect to the direction of sliding of the stack, the stapled corner of each stack that is deposited and pivoted toward the alignment surface is outside the path of sliding movement of each subsequent stack. Therefore, the staple of the preceding stack cannot hinder sliding of the subsequent stack. This results in the additional advantage of increased operational reliability during receiving of the stacks.

In the case of preferred embodiments, the lower abutment can be designed as a rotating means. In such embodiments, the lower abutment is spaced from the alignment surface at a distance greater than half the width of each stack to be rotated, measured vertically to the direction of sliding. Consequently, the abutment serves as a means which translates the sliding movement of the stack into rotary movement. Since the stack moving toward the abutment during its sliding movement contacts the abutment with an edge area which is eccentric, i.e., offset from the central point of gravity, a torque is generated during abutment by which the stack is pivoted toward the alignment surface. Of course, other rotating means could also be provided, e.g., a drivable rotary brush or the like.

The abutment may consist of a lower container end wall which limits the support surface and is inclined toward the direction of sliding and which defines a right angle with the alignment surface. Under such circumstances, the stack moving downwardly in the direction of sliding abuts the end wall with its lower end area, which is remote from the alignment surface, acting as an abutment eccentrically influencing the stack. In the case of particularly advantageous embodiments of the invention, the abutment does not take the form of a continuous end wall but has a curved shape so that contact with the stacks occurs substantially at a contact line which extends at least approximately vertically to the main plane of the stack. Such line contact is particularly suitable for generating the desired torque of the stack. Such embodiments may feature a plurality of abutments for stacks of different sheet widths, measured transversely to the direction of sliding. The abutments would be arranged at different distances from the alignment surface with each of them being respectively provided for one associated sheet width. Depending on their size and format, the stacks can thus each be influenced by the abutment at the point most suitable for causing the rotary movement.

The invention, and its objects and advantages, will become more apparent in the detailed description of the preferred embodiment presented below.

BRIEF DESCRIPTION OF THE DRAWINGS

In the following, the invention will be explained in detail with reference to an embodiment illustrated in the accompanying drawings in which.

DESCRIPTION OF THE PREFERRED EMBODIMENTS

Figure 1:
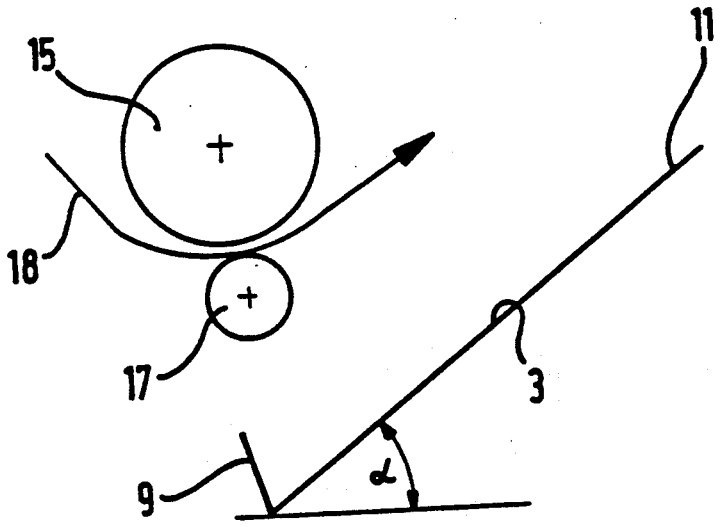
FIG. 1 is a schematically illustrated side view of an embodiment of a support surface formed by the bottom of a container, with transport rollers located above the lower edge thereof.

As can be seen from FIG. 3, the embodiment according to this invention represents a container whose bottom forms a support surface 1 which, as explained in more detail below, is composed of several partial surfaces which are disposed at different angles to a reference plane 3 (see FIG. 1). The reference plane 3 is inclined toward the horizontal, forming an angle $\alpha$ as shown in FIG. 1 which in the case of the illustrated embodiment is 45°. The support surface 1 is enclosed on three sides by side walls 5, 7 and 9 of which the side walls 5 and 7 extend vertically to the reference plane 3. Side wall 9 which, according to its inclination (angle $\alpha$) to the horizontal, is the lower side wall which limits the lower edge of the support surface and defines an acute angle with reference plane 3, see FIG. 1. At its upper edge 11 facing away from the lower side wall 9 the container is open.

Figure 2:
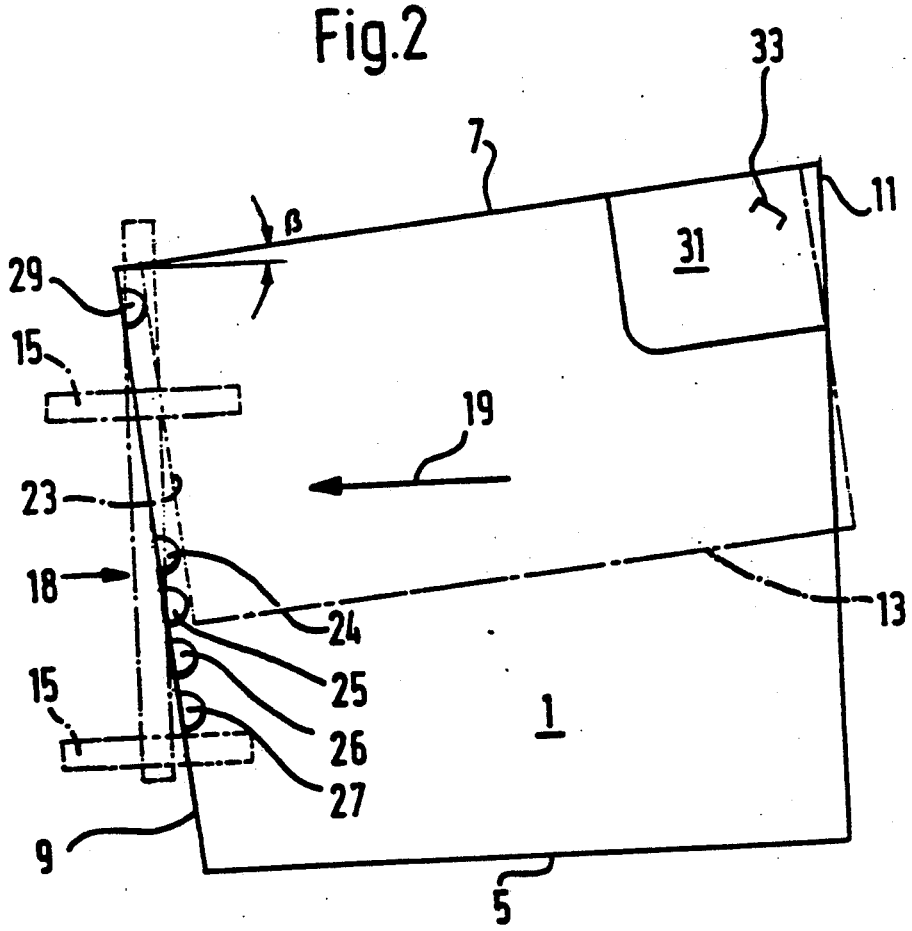
FIG. 2 is a schematic plan view of the support surface according to FIG. 1.

Stapled sheet stacks, of which a stack received in the container is shown in dash-dotted contour lines in FIG. 2 and denoted 13, may be fed as desired in any manner usual in sheet or sheet stack handling apparatus. In the case of the illustrated embodiment, upper and lower transport rollers 15 and 17 respectively cooperate as a dispensing means for the stacks fed, such transport rollers (see FIG. 1) being arranged above the lower side wall 9 of the container and advancing the stacks 13 along a transport path 18. The stacks 13 when released by the transport rollers 15, 17 and having dropped into the container, carry out a sliding movement as caused by the inclination of the reference plane 3 of support surface 1, the sliding direction 19 corresponding to the direction of the line of the steepest gradient which in FIG. 2 is indicated by an arrow. When moving in the direction of sliding 19, the stacks 13 make contact with the lower side wall 9.

As can be inferred from FIG. 2, side wall 7 is oblique with respect to the direction of the transport path 18 and the sliding direction 19. The angle of inclination $\beta$ is indicated in FIG. 2 at the corner between the side wall 7 and the lower side wall 9. In the case of the present embodiment, the angle $\beta$ is 12° and opens starting from the vertex at the corner of the side walls 7 and 9 in opposition to the direction of sliding 19. The side walls 7 and 9 are vertical to each other. Consequently, the lower side all 9 is also inclined with respect to the direction of sliding 19.

When the sheet stacks 13 have slid downwardly across support surface 1, they are located within the container in a position in which their edges facing side wall 7 rest against the inner side thereof. This inner side of side wall 7 is referred to as alignment surface 21 in the following description. The edges of the stacks are pivoted toward the alignment surface 21 by rotary movement of the stacks. Such rotary movement is caused by sliding movement carried out under the action of the stack weight along support surface 1 in the sliding direction 19 toward the lower side wall 9 being translated into a rotary movement when the stack abuts the side wall. For this purpose abutments 24, 25, 26, 27 are provided for the lower edges 23 of the stacks 13. The sheet stack 13 would be pivoted toward the alignment surface 21 even as a result of the aforementioned inclination of the lower side wall 9 relative to the direction of sliding 19.

In the case of the present embodiment, the lower edge 23 of stack 13 does not directly abut the side wall 9 when sliding downwardly but contacts individual abutments 24, 25, 26 and 27 on the inner side of side wall 9. The abutments 24 to 27 are distributed along side wall 9 at points where they can cooperate with sheet stacks 13 of different widths, measured transversely to the direction of sliding 19. The point where an abutment 24 to 27 associated with a particular size first influences the lower edge 23 of stack 13 is associated with a point of the lower edge of the stack 13 which is positioned eccentrically between the two ends of the stack edge and is spaced from the corner between the side walls 7 and 9 at a distance greater than half the length of the lower stack edge. The abutments 24 to 27 have a semicylindrical shape, with the cylinder axes being positioned substantially in the plane of side wall 9. The abutments 24 to 27 are of substantially equal dimensions so that their common tangent extends parallel with side wall 9. The abutment 27 which is most remote from alignment surface 21 of side wall 7 extends furthest into the interior of the container, in opposition to the direction of sliding 19, whereas the abutments 26, 25 and 24 which are closer to alignment surface 21 each extend less far into the container, in opposition to the direction of sliding 19. A counterabutment 29 which is substantially identical with the abutments 24 to 27 and arranged near the corner beside side wall 7 forms, with the abutments 24 to 27, a straight tangent line for the contact of the lower edges 23 of stacks 13, when the stacks 13 rest with their side edges against the alignment surface 21.

Due to this action of the abutments 24 to 27 and the counterabutment 29, each stack 13 of a specific size first abuts one of the abutments 24 to 27, depending on its width, and is thus rotated about its vertical axis until it contacts the counterabutment 29 and the alignment surface 21. Accordingly, the staple 33 in the stapled corner of the stack is deflected out of the path of a subsequent stack fed by transport rollers 15, 17 even before the stapled corner has been lowered into recess 31. The arrangement and design of the abutments 24 to 27 thus prevents the stapled corners from being deformed by the abutment because the corners do not contact either the lower side wall 9 or the abutments 24 to 27.

Figure 3:
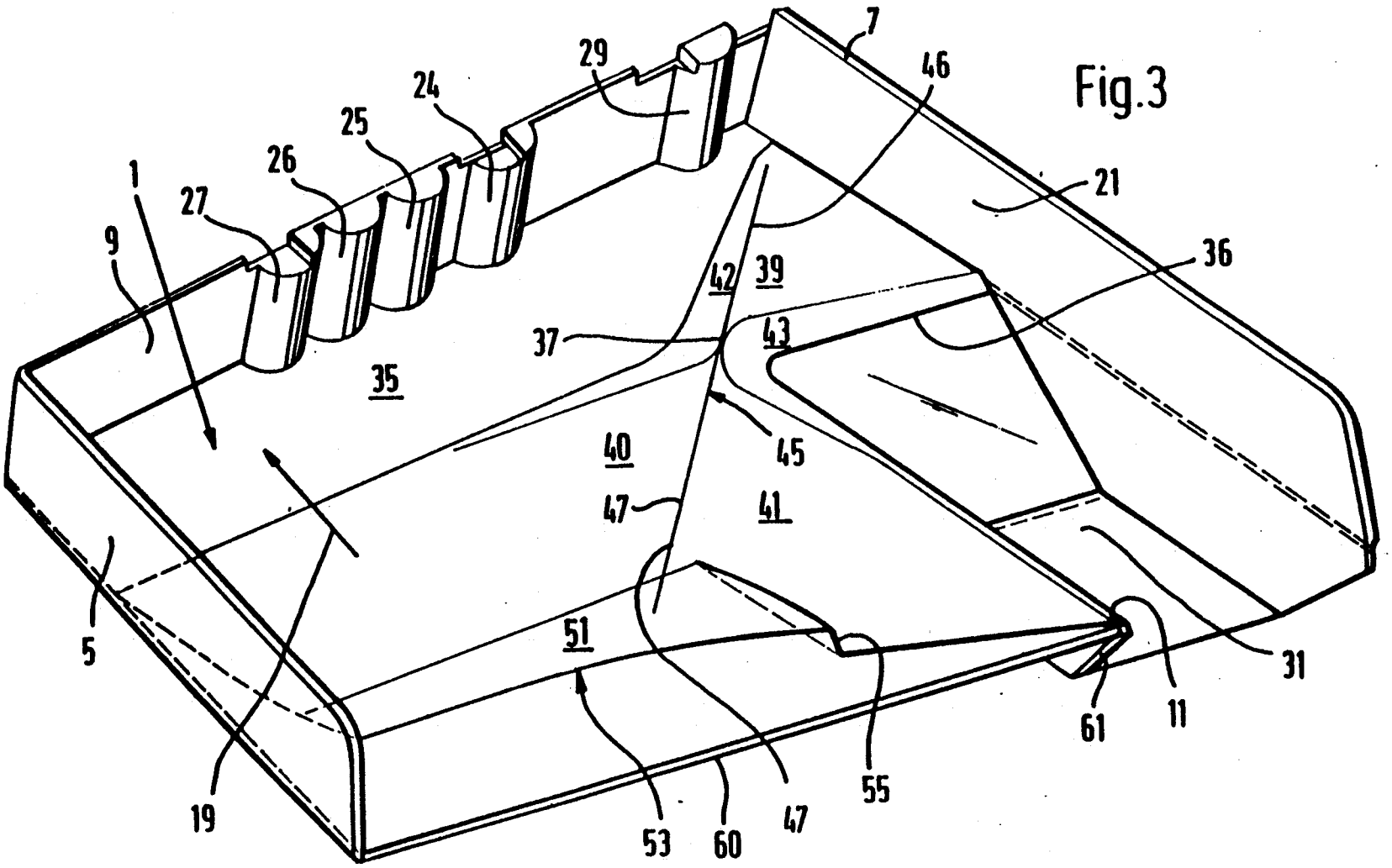
FIG. 3 is a perspective view of the embodiment of the container, seen obliquely from above and illustrated on a larger scale than in FIGS. 1 and 2.

The design of support surface 1 is described with special reference to FIG. 3. Near the upper edge 11 of support surface 1 and adjacent to side wall 7, a recess is provided in support surface 1, which in the case of the embodiment takes the form of a troughlike recess 31. The recess 31 allows those corners of the sheet stacks 13 which are connected by staples 33 (FIG. 2) to be lowered with respect to the remainder of the stack. The remaining area of the support surface 1 outside the recess 31 has a special shape which is composed of various partial surfaces. Contiguous with the lower side wall 9, a plane ground surface 35 is provided which is located in the reference plane 3. Edge 36 of recess 31, which is shown in full lines in FIG. 3, also lines within reference plane 3. Further partial surfaces disposed outside ground surface 35 and recess 31 are inclined toward the reference plane 3 such that an elevation rising upwardly from reference plane 3 is formed whose peak area (denoted 37 in FIG. 3) is closer to the abutments 24 to 27 on the lower side wall 9 than to the upper edge 11 of support surface 1, and which has a slightly smaller distance from side wall 7, measured vertically to the alignment surface 21, than abutment 24 which is closest to alignment surface 21. Using such an arrangement, the peak area 37 can be positioned in the vicinity of the diagonal of the sheets if a sheet stack 13 having a usual standard size (e.g., DIN A5) is deposited in a transverse position, i.e., if the short sides of the sheets are parallel with the alignment surface 21. In the case of sheet stacks 13 of larger sheet formats, the peak area 37 can be associated with that half of the deposited stack 13 which is separated by a diagonal from the half containing the stapled corner, independently of whether the stack is deposited transversely or in the longitudinal direction.

The design and inclination of partial surfaces adjacent to the peak area 37 are chosen such that a substantially straight ridge 45 is created in the peak area. A first section 46 of the ridge 45 rises from the corner area between the lower side wall 9 and the alignment surface 21 up to the elevation and separates a narrow partial surface 42, which rises steeply from ground surface 35, from a substantially triangular partial surface 39 which extends via a steeply dropping narrow partial surface 43 down to the edge 36 of recess 31. A second section 47 of ridge 45 extends at an approximately constant height across reference plane 3 from the elevation into the vicinity of the upper edge 11 of support surface 1 and separates a substantially trapezoidal partial surface 40 from a substantially triangular partial surface 41 which reaches via the steeply dropping partial surface 43 down to recess 31. The side of partial surface 40 adjacent to the ground surface 35 extends in part beyond partial surface 42 up to ground surface 35. The partial surfaces 39 to 43 meet in the peak area 37. The partial surfaces 42 and 43 drop from their highest areas adjacent to the peak area 37 down to ground surface 35 and edge 36 of recess 31 respectively and thus form relatively steep slopes down to the reference plane 3.

A ramp surface 51, which forms the upper continuation of partial surface 40 and part of partial surface 41 in the direction toward the upper edge 11, rises from those partial surfaces 40, 41 so that a second elevation in the form of a ramp 53 is created which rises in a direction opposite to the direction of sliding. That side of the ramp which is substantially parallel with the alignment surface 21 terminates via a relatively steep slope 55 in partial surface 41. The distance of the steep slope 55 from alignment surface 21 is slightly greater than the greatest width of the stack 13 to be received, measured vertically to the direction of sliding 19.

Due to the special shape of the support surface 1 as illustrated in the drawings, the stack 13 received thereon is supported in a special way and thus loses its inherent stiffness so that the stapled corners of the stacks 13 reliably drop downwardly in the area of recess 31. As a result of the second elevation in the form of ramp 53 which is provided in addition to peak area 37, the center of gravity of the sheet stack is raised so that large size stacks, i.e., stacks with long sheet formats, measured along the direction of sliding 19, slip reliably in the direction of sliding 19 and contact one of the abutments 24 to 27 to be reliably rotated toward the alignment surface 21. Consequently, ramp 53 prevents long-size stacks from sagging too far at the upper edge 11 of support surface 1, which would hinder their sliding in the direction of sliding 19. At the same time rotation by ramp 53 is enhanced in the case of particularly long-size stacks if such stacks slip across the steep slope 55 of ramp 53 with their upper side edges facing away from the stapled corners during rotation.

In order to translate the sliding movement of the stacks 13 along the direction of sliding 19 into rotary movement by which they are placed into contact with alignment surface 21, the abutments 24 to 27 are given a curved design so that substantially a line contact is established with the lower edge 23 of stack 13 when it contacts abutments 24 to 27.

The support surface 1 is obtained in that on a plane plate whose surface forms the ground surface 35 and edge 36 of recess 31 and which is provided with an opening for recess 31, a body is mounted which is molded as an integral unit and which features the partial surfaces 39 to 43 and the ramp 53. The edge 36 of plate 60 is connected with a box 61 surrounding the recess, such box being open at the top and in a direction opposite to the sliding direction.

The above description and the drawings are confined to the features which are essential to illustrate an embodiment of the invention. Inasmuch as features disclosed in the description and in the drawings are not mentioned in the claims, they also serve, if necessary, to define the subject matter of the invention.

We claim:

1. Container for receiving stacks of sheets which are connected in one corner by staples (33), said container comprising:

a support surface (1) including a recess (31) defined at a side edge of said support surface (1) for the stapled corners of stacks (13) of sheets received on said support surface (1), said support surface (1) being uneven relative to an imaginary reference plane (3) and having an elevation rising above said reference plane (3) provided adjacent to the edge (36, 43) of said recess (31).

2. Container according to claim 1, wherein said elevation is associated with that half of a stack (13) to be received of said support surface which is separated by a diagonal from the half which includes the stapled corner.

3. Container according to claim 1, wherein said elevation is located adjacent to the diagonal of a stack (13) to be received on said support surface.

4. Container according to claim 3, wherein said edge (36, 43) of said recess (31) extends up to the area of said elevation.

5. Container according to claim 4, wherein said elevation forms a peak area (37) of said support surface (1), with said support surface rising up to said elevation.

6. Container according to claim 5, wherein reference plane (3), and thus said support surface (1), are inclined with respect to the horizontal and a direction of sliding (19) of said stack (13) relative to said support surface (1) is thus defined, an abutment (24 to 27) provided at the lower edge of said support surface (1), and said recess (31) arranged at the upper edge (11) of said support surface (1).

7. Container according to claim 6, wherein said peak area (37) forms a substantially rectilinear ridge (45) whose first section (46) rises from the corner area between said abutment and the side edge adjacent to said recess (31) up to said elevation, and whose second section (47) extends at an approximately constant height above said reference plane (3) from said peak area (37) up to the upper edge (11) of said support surface (1).

8. Container according to claim 7, wherein said support surface (1) consists of partial surfaces (35, 39 to 43) of which a ground surface (35) which is located with said reference plane (3) is substantially trapezoidal with its long parallel side forming at least a portion of the lower edge of support surface (1).

9. Container according to claim 8, wherein said first ridge section (46) separates a partial surface (42) steeply rising from said ground surface (35) from a substantially triangular partial surface (39) which extends across a steeply inclined narrow partial surface (43) down to said edge (36) of said recess (31).

10. Container according to claim 9, wherein said second ridge section (47) separates a substantially trapezoidal partial surface (40) from a substantially triangular partial surface (41) which extends across said steeply inclined partial surface (43) down to said edge (36) of said recess (31).

11. Container according to claim 10, wherein said edge (36) of said recess (31) is positioned within said reference plane (3).

12. Container according to claim 10, wherein in the area of the upper edge (11) of said support surface (1), a second elevation is provided which is positioned at a distance from said recess (31), measured vertically to the direction of sliding (19) of said stack received on said support surface, said elevation having substantially the shape of a ramp (53) which rises in a direction opposite to the direction of sliding (19).

13. Container according to claim 12, wherein said ramp (53) has a ramp surface (51) which rises in opposition to the direction of sliding (19) and which terminates in said partial surface (41) via a steep slope (55) which is substantially parallel with an aligning surface (21), the distance of said slope (55) from said aligning surface being slightly greater than the maximum width of the stacks (13) to be received on said support surface, measured vertically to the direction of sliding (19).

14. Container according to claim 13, wherein said alignment surface (21) for the side edge of the stack (13) received on said support surface, extending along the direction of sliding (19), is provided adjacent to said recess (31), said alignment surface (21) defining an upwardly opening, acute angle ($\beta$) with the direction of sliding (19) of such stack (13), and a rotating means by which such stacks (13) contacting said abutment can be rotated in order that their side edges running along the direction of sliding (19) can be brought into contact with said alignment surface (21).

15. Container according to claim 14, wherein said abutment is designed as a rotating means spaced from said alignment surface (21) at a distance greater than half the width of the stack (13) to be rotated, measured vertically to the direction of sliding (19).

16. Container according to claim 15, wherein said abutment has a curved shape such that contact with the stacks (13) is effected substantially along a contact line which extends at least approximately vertically to said reference plane (3).

17. Container according to claim 16, wherein a plurality of abutments (24 to 27) is provided for stacks (13) having different sheet widths, measured transversely to the direction of sliding (19), said abutments being arranged at different distances from said alignment surface (21).

18. Container according to claim 17, wherein each of said abutments (24, 25, 26, 27) forms a projection facing the stacks, and said projection (24) closest to said alignment surface (21) projects least into said container, and said projections (25, 26, 27) further remote from said surface project increasingly further into said container, in opposition to the direction of sliding (19).

19. Container according to claim 18, wherein said abutments (24 to 27) take the form of circular cylinder sections whose respective cylinder axes are at least approximately vertical to said reference plane (3).

20. Container according to claim 19, wherein said alignment surface (21) defines an angle ($\beta$) of about 12° with the direction of sliding (19).

21. Container according to claim 6, wherein said reference plane (3) of said support surface (1) is inclined by an angle ($\alpha$) of at least about 45° to the horizontal.

* * * * *